US006617791B2

(12) United States Patent
Symons

(10) Patent No.: US 6,617,791 B2
(45) Date of Patent: Sep. 9, 2003

(54) INDUCTIVE OUTPUT TUBE WITH MULTI-STAGED DEPRESSED COLLECTOR HAVING IMPROVED EFFICIENCY

(75) Inventor: Robert Spencer Symons, Los Altos, CA (US)

(73) Assignee: L-3 Communications Corporation, San Carlos, CA (US)

( * ) Notice: Subject to any disclaimer, the term of this patent is extended or adjusted under 35 U.S.C. 154(b) by 0 days.

(21) Appl. No.: 10/158,975

(22) Filed: May 31, 2002

(65) Prior Publication Data

US 2002/0180362 A1 Dec. 5, 2002

Related U.S. Application Data

(60) Provisional application No. 60/294,956, filed on May 31, 2001.

(51) Int. Cl.[7] ..... H01J 23/02

(52) U.S. Cl. ..... 315/5.38; 315/5.35; 315/15; 315/404

(58) Field of Search ..... 315/4, 5, 5.32–5.38, 315/15, 16, 403, 404

(56) References Cited

U.S. PATENT DOCUMENTS

| | | | |
|---|---|---|---|
| 2,325,865 A | 8/1943 | Litton | |
| 3,368,104 A | 2/1968 | McCullough | 315/5.38 |

(List continued on next page.)

FOREIGN PATENT DOCUMENTS

| | | |
|---|---|---|
| DE | 75 32 912 | 3/1977 |
| EP | 0181214 | 5/1986 |
| GB | 547715 | 9/1942 |
| GB | 1 430 005 | 3/1976 |
| GB | 1 549 923 | 8/1979 |
| GB | 2 143 370 | 6/1984 |
| GB | 2 139 413 | 11/1984 |
| GB | 2 243 943 | 11/1991 |
| GB | 2 244 854 | 12/1991 |
| GB | 2 245 414 | 1/1992 |
| GB | 2 279 496 | 1/1995 |
| WO | PCT/GB94/00774 | 10/1994 |

OTHER PUBLICATIONS

Design of An 850–MHz Klystrode By B. Goplen et al., 1990 IEEE, IEDM 90–889–892.

Depressed Collector Klystrons For High Efficiency UHF Television By Robert S. Symons, presentation at Broadcast Engineering Conference at 1982 National Association of Broadcasters Convention, pp. 90–95.

Modern Multistage Depressed Collectors–A Review By Henry G. Kosmahl, Proceedings Of The IEEE, vol. 70, No. 11, Nov. 1982, pp. 1325–1334.

Microwave Tubes By A.G. Gilmour, Jr., Artech House, Inc., 1986, Chapter 8 Gridded Tubes, Section 8.3 Klystrods, pp. 196–200; Chapter 12 Efficiency Enhancement, pp. 322–340.

A UHF–TV Klystron Using Multistage Depressed Collector Technology By E.W. McCune, IEDM 86, 1986 IEEE, pp. 160–163.

(List continued on next page.)

*Primary Examiner*—Haissa Philogene
(74) *Attorney, Agent, or Firm*—O'Melveny & Myers LLP

(57) ABSTRACT

An inductive output tube (IOT) of a multi-staged depressed collector provides improved efficiency by approximating a Brillouin electron beam flow. In one embodiment, an IOT is provided with an electron gun that generates an electron beam, a tube body, a multi-staged depressed collector for collecting the electron beam, and a magnetic solenoid. The electron beam travels through the tube body. The magnetic solenoid produces a magnetic flux that focuses the electron beam as it travels through the tube body. The magnetic flux includes a portion that threads through the electron gun. The IOT is adapted to reduce this portion of the magnetic flux in order to provide improvements in the efficiency of the IOT.

28 Claims, 3 Drawing Sheets

U.S. PATENT DOCUMENTS

| | | | | | |
|---|---|---|---|---|---|
| 4,096,409 | A | | 6/1978 | Hechtel | 315/5.38 |
| 4,101,804 | A | | 7/1978 | Carlsson | 315/5.38 |
| 4,277,721 | A | | 7/1981 | Kosmahl | 315/5.38 |
| 4,395,656 | A | | 7/1983 | Kosmahl | 315/4 |
| 4,480,210 | A | | 10/1984 | Preist et al. | 315/4 |
| 4,611,149 | A | | 9/1986 | Nelson | 313/293 |
| 4,733,192 | A | | 3/1988 | Heppinstall et al. | 330/45 |
| 4,737,680 | A | | 4/1988 | True et al. | 315/5.37 |
| 4,794,303 | A | | 12/1988 | Hechtel et al. | 315/5.38 |
| 5,239,272 | A | | 8/1993 | Bohlen et al. | 330/45 |
| 5,281,923 | A | | 1/1994 | Heppinstall | 315/5.37 |
| 5,283,534 | A | | 2/1994 | Bohlen et al. | 330/45 |
| 5,291,290 | A | | 3/1994 | Vaughan et al. | 348/723 |
| 5,317,233 | A | | 5/1994 | Lien et al. | 315/5.37 |
| 5,420,478 | A | | 5/1995 | Scheitrum | 315/5.38 |
| 5,440,202 | A | | 8/1995 | Mathews et al. | 315/5.38 |
| 5,536,992 | A | | 7/1996 | Crompton | 313/293 |
| 5,548,245 | A | | 8/1996 | Bohlen et al. | 330/45 |
| 5,572,092 | A | | 11/1996 | Shrader | 315/5.37 |
| 5,650,751 | A | | 7/1997 | Symons | 315/5.37 |
| 5,780,970 | A | * | 7/1998 | Singh et al. | 315/5.38 |
| 5,990,622 | A | * | 11/1999 | Schult et al. | 315/5.37 |
| 6,084,353 | A | * | 7/2000 | Bohlen | 315/5.32 |
| 6,133,786 | A | * | 10/2000 | Symons | 330/44 |
| 6,191,651 | B1 | * | 2/2001 | Shrader | 330/44 |
| 6,392,187 | B1 | * | 5/2002 | Johnson | 219/121.43 |
| 6,429,589 | B2 | * | 8/2002 | Schult | 315/5.37 |
| 6,462,474 | B1 | * | 10/2002 | Symons | 315/3 |

OTHER PUBLICATIONS

Some Exciting Adventures In The IOT Business By Clayworth et al., NAB 1992 Broadcast Engineering Conference Proceeding, pp. 200–208.

A Wide–Band Inductive–Output Amplifier By Haeff et al., Proceedings of the I.R.E., Mar. 1940, pp. 126–130.

An Ultra–High Frequency Power Amplifier Of Novel Design By A.V. Haeff, Electronics, Feb. 1939, pp. 30–32.

The Klystrode–An Unusual Transmitting Tube With Potential For UHF–TV By Donald H. Preist and Merrald B. Shrader, Proceedings Of The IEEE, vol. 70, No. 11, Nov. 1982, pp. 1318–1325.

* cited by examiner

FIG. 3
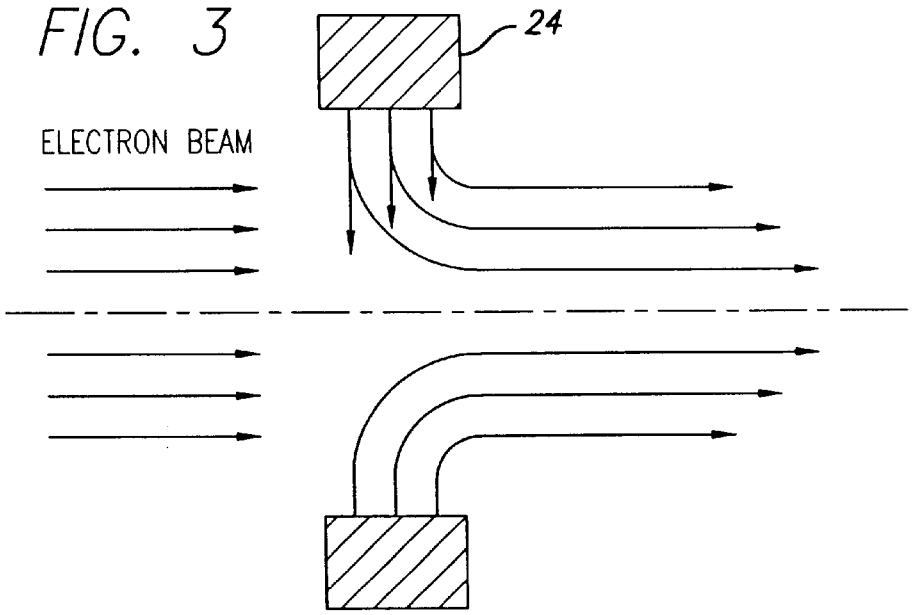
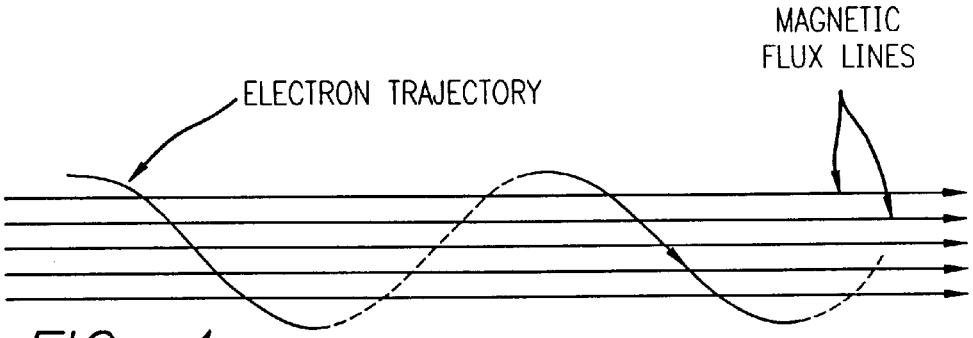
FIG. 4
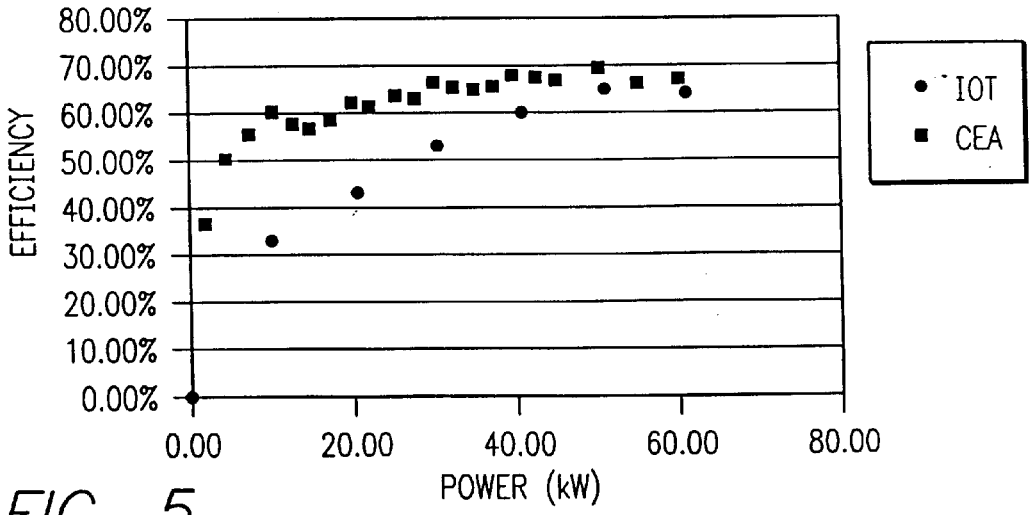
FIG. 5

INDUCTIVE OUTPUT TUBE WITH MULTI-STAGED DEPRESSED COLLECTOR HAVING IMPROVED EFFICIENCY

RELATED APPLICATION DATA

This application claims priority pursuant to 35 U.S.C. §119(e) to U.S. Provisional Application No. 60/294,956, filed May 31, 2001, for INDUCTIVE OUTPUT TUBE WITH MULTI-STAGED DEPRESSED COLLECTOR HAVING IMPROVED EFFICIENCY.

BACKGROUND OF THE INVENTION

1. Field of the Invention

The present invention relates to linear beam devices used for amplifying a radio frequency (RF) signal, such as inductive output tubes. More particularly, the invention relates to an inductive output tube having a multi-staged depressed collector configured to achieve improved efficiency.

2. Description of Related Art

It is well known in the art to utilize a linear beam device, such as a klystron or traveling wave tube amplifier, to generate or amplify a high frequency RF signal. Such devices generally include an electron emitting cathode and an anode spaced therefrom. The anode includes a central aperture, and by applying a high voltage potential between the cathode and anode, electrons may be drawn from the cathode surface and directed into a high power beam that passes through the anode aperture. One class of linear beam device, referred to as an inductive output tube (IOT), further includes a grid disposed in the inter-electrode region defined between the cathode and anode. The electron beam may thus be density modulated by applying an RF signal to the grid relative to the cathode. After the anode accelerates the density-modulated beam, the beam propagates across a gap provided downstream within the IOT and RF fields are thereby induced into a cavity coupled to the gap. The RF fields may then be extracted from the output cavity in the form of a high power, modulated RF signal.

At the end of its travel through the linear beam device, the electron beam is deposited into a collector or beam dump that effectively captures the remaining energy of the spent electron beam. The electrons that exit the drift tube of the linear beam device are captured by the collector and returned to the positive terminal of the cathode voltage source. Much of the remaining energy of the electrons is released in the form of heat when the particles strike a stationary element, such as the walls of the collector. This heat loss constitutes an inefficiency of the linear beam device, and as a result, various methods of improving this efficiency have been proposed.

One such method is to operate the collector at a "depressed" potential relative to the body of the linear beam device. In a typical linear beam device, the body of the device is at ground potential and the cathode potential is negative with respect to the body. The collector voltage is depressed by applying a potential that is between the cathode potential and ground. By operating the collector at a depressed potential, the opposing or decelerating electric field within the collector slows the moving electrons so that they can be collected at reduced velocities. This method increases the electrical efficiency of the linear beam device as well as reducing undesirable heat generation within the collector.

It is also known for the depressed collector to be provided with a plurality of electrodes arranged in sequential stages in a structure referred to as a multi-staged depressed collector. Electrons exiting the drift tube of the linear beam device actually have varying velocities, and as a result, the electrons have varying energy levels. To accommodate the differing electron energy levels, the respective electrode stages have incrementally increasing negative potentials applied thereto with respect to the linear device body, such that an electrode having the highest negative potential is disposed the farthest distance from the interaction structure. This way, electrons having the highest relative energy level will travel the farthest distance into the collector before being collected on a final one of the depressed collector electrodes. Conversely, electrons having the lowest relative energy level will be collected on a first one of the depressed collector electrodes. By providing a plurality of electrodes of different potential levels, each electron can be collected on a corresponding electrode that most closely approximates the electron's particular energy level. Thus, efficient collection of the electrons can be achieved.

As disclosed in U.S. Pat. No. 5,650,751, a substantial improvement in efficiency of an IOT can be realized by operating the device with a multi-staged depressed collector. When the IOT is configured such that beam current passes through the IOT during a portion of a full cycle of the RF input signal, both the DC current and collection voltage would go up and down with the RF output voltage, and both would be proportional to the RF output voltage or the square root of the output power. In other words, the input power would be proportional to the output power at all power levels, thereby providing very nearly constant efficiency across the operating range of the device with a proper choice of collector electrode voltages. An IOT having a multi-stage depressed collector is therefore referred to herein as a constant efficiency amplifier (CEA). The aforementioned U.S. Pat. No. 5,650,751 is incorporated by reference herein in its entirety.

Accordingly, it would be desirable to further improve the efficiency achieved by a constant efficiency amplifier.

SUMMARY OF THE INVENTION

The present invention satisfies the need for an inductive output tube (IOT) having a multi-staged depressed collector that provides further improvements in efficiency. In accordance with the teachings of the present invention, an IOT having a multi-stage depressed collector is referred to herein as a constant efficiency amplifier (CEA).

In a first embodiment, a CEA is provided with an electron gun and has a tube body. The electron gun generates an electron beam. The electron beam travels through the tube body. The CEA is also provided with a magnetic solenoid that produces a magnetic flux that focuses the electron beam as it travels through the tube body. The magnetic flux includes a portion that threads through the electron gun. The CEA is adapted to reduce this portion of the magnetic flux in order to further improve the efficiency achieved by the CEA.

In a second embodiment, an amplifying apparatus is provided with an electron gun. The electron gun has a cathode, an anode, and a grid disposed between the cathode and anode. The anode is spaced a distance away from the cathode. The cathode provides an electron beam that passes through the grid and the anode. The grid is coupled to an input radio frequency signal that density modulates the electron beam. The amplifying apparatus is also provided with a drift tube that is spaced away from the electron gun. The drift tube surrounds the electron beam (produced by the electron gun) and contains a first portion and a second portion. A gap is defined between the first and second portions. A polepiece is connected with the drift tube and holds the first portion in an axial position relative to the cathode and the grid. The polepiece also has a first side facing the cathode and a second side facing away from the cathode. The amplifying apparatus is further provided with an output cavity coupled with the drift tube. The density modulated electron beam passes across the gap and couples an amplified radio frequency signal into the output cavity. The amplifying apparatus also contains a depressed collector spaced away from the drift tube. The electron beam passes into the collector after transit across the gap. The collector has a plurality of electrode stages. Each of the stages is adapted to have a respective electric potential applied to it.

A first magnetic solenoid is located on the second side of the polepiece. The first magnetic solenoid generates a magnetic flux line. The magnetic flux line guides the electron beam as it passes through the gap. A portion of the magnetic flux line threads through the cathode. A second magnetic solenoid is located on the first side of the polepiece and produces a magnetic field that effectively cancels the portion of the magnetic flux line that threads through the cathode. Alternatively, the polepiece may have a hole extending through the polepiece in the axial position relative to the cathode and the grid. The diameter of the hole is dimensioned to reduce the portion of the magnetic flux line that threads through the cathode.

In addition, the plurality of electrodes stages may include a first electrode stage and a plurality of remainder electrode stages. In one embodiment, the plurality of remainder electrode stages include a last stage. The last stage has an inner length and a minimum inner diameter. The inner length is at least twice the minimum inner diameter. In another embodiment, the plurality of remainder electrode stages include at least two stages that are connected together electrically. The two stages of the plurality of remainder electrode stages include a total inner length and a minimum inner diameter. The total inner length exceeds twice the minimum inner diameter. In an alternate embodiment, the plurality of remainder electrode stages include a last stage and a penultimate stage. The last stage is connected to a potential slightly higher than that of the penultimate stage.

A more complete understanding of the present invention will be afforded to those skilled in the art, as well as a realization of additional advantages and objects thereof, by a consideration of the following detailed description of the embodiment. Reference will be made to the appended sheets of drawings, which first will be described briefly.

BRIEF DESCRIPTION OF THE DRAWING

FIG. 3 is a schematic illustration of the electron beam entering a magnetic field region in which the magnetic flux lines are primarily radial;

FIG. 4 is a schematic illustration of the electron trajectory within an axial magnetic field; and FIG. 5 is a graph illustrating a comparison between the efficiency of a constant efficiency amplifier constructed in accordance with the invention and a conventional IOT.

DETAILED DESCRIPTION OF THE PREFERRED EMBODIMENT

The present invention satisfies the need for an inductive output tube having a multi-staged depressed collector that provides further improvements in efficiency. In the detailed description that follows, like element numerals are used to describe like elements illustrated in one or more of the figures.

Figure 1:
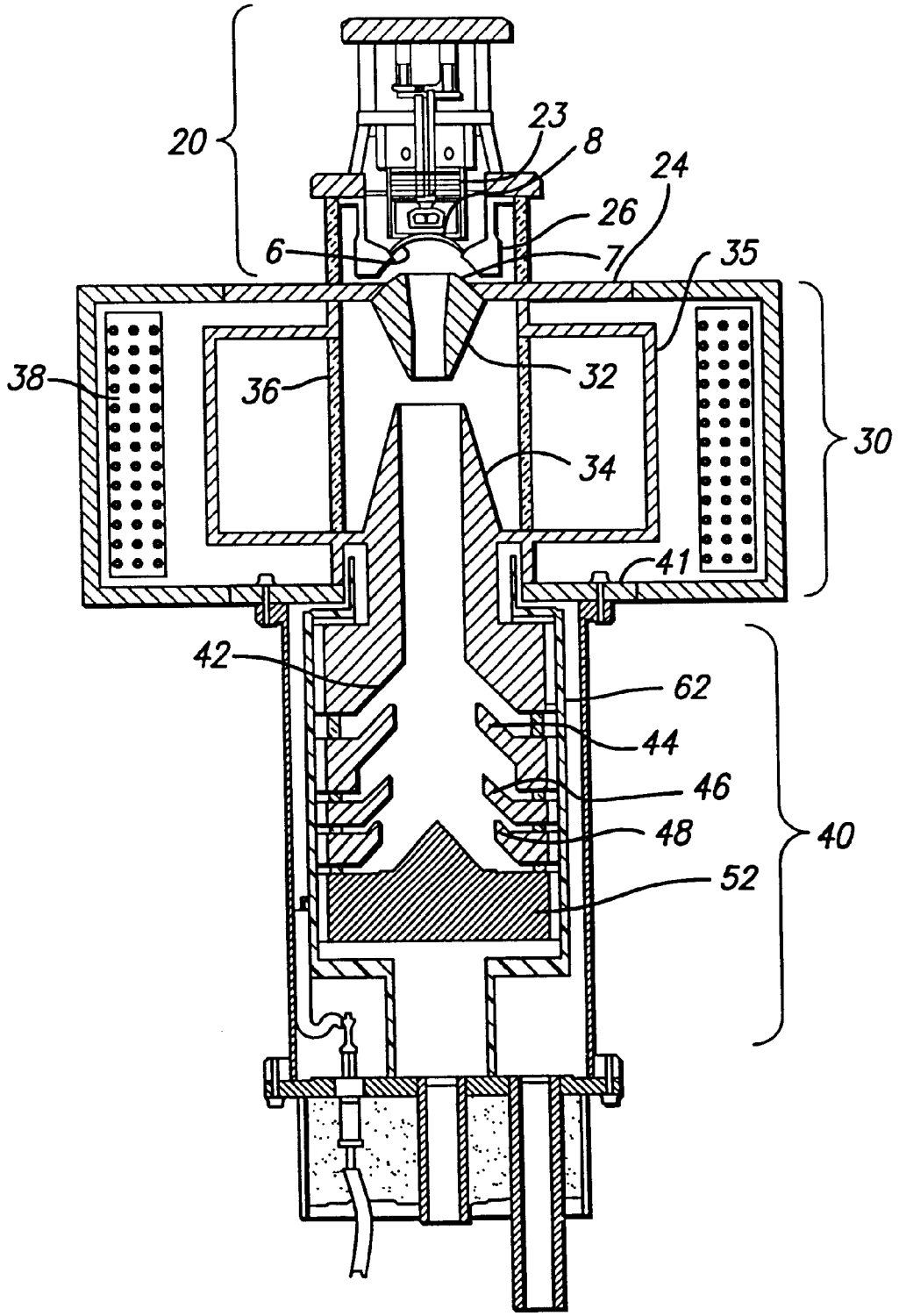
FIG. 1 is a sectional side view of an exemplary inductive output tube having a multi-staged depressed collector.

FIG. 1 illustrates an inductive output tube in accordance with an embodiment of the invention. The inductive output tube includes three major sections, including an electron gun 20, a tube body 30, and a collector 40. The electron gun 20 provides an axially directed electron beam that is density modulated by an RF signal. The electron gun 20 further includes a cathode 8 with a closely spaced control grid 6. The cathode 8 is disposed at the end of a cylindrical capsule 23 that includes an internal heater coil coupled to a heater voltage source. The control grid 6 is positioned closely adjacent to the surface of the cathode 8, and is coupled to a bias voltage source to maintain a DC bias voltage relative to the cathode 8. An input cavity receives an RF input signal that is coupled between the control grid 6 and cathode 8 to density modulate the electron beam emitted from the cathode 8. An example of an input cavity for an inductive output tube is provided by U.S. Pat. No. 6,133,786, the subject matter of which is incorporated in the entirety by reference herein. The control grid 6 is physically held in place by a grid support 26. An example of a grid support structure for an inductive output tube is provided in U.S. Pat. No. 5,990,622, the subject matter of which is incorporated in the entirety by reference herein. An inner surface of the grid support 26 provides a focusing electrode 25 used to shape the electron beam as it exits the cathode 8 and control grid 6.

The modulated electron beam passes through the tube body 30, which further comprises a first drift tube portion 32 and a second drift tube portion 34. The first and second drift tube portions 32, 34 each have an axial beam tunnel extending therethrough, and are separated from each other by a gap. An RF transparent shell 36, such as comprised of ceramic materials, encloses the drift tube portions and provides a vacuum seal for the device. The leading edge of the first drift tube portion 32 is spaced from the grid structure 26, and provides an anode 7 for the electron gun 20. The first drift tube portion 32 is held in an axial position relative to the cathode 8 and grid 6 by a first polepiece 24. An output cavity 35 is coupled to the RF transparent shell 36 to permit RF electromagnetic energy to be extracted from the modulated beam as it traverses the gap. An example of an output cavity for an inductive output tube is provided in U.S. Pat. No. 6,191,651, the subject matter of which is incorporated in entirety by reference herein. The tube body 30 is further enclosed by a magnetic solenoid that includes a magnetic coil 38. Flux generated by the magnetic coil 38 flows to the axial beam tunnel through the first polepiece 24 and a second polepiece 41 that define a magnetic circuit. The first and second polepieces 24, 41 are each comprised of a magnetically conductive material such as iron. As will be further described below, the magnetic flux serves to guide the electron beam as it passes through the axial beam tunnel.

The collector 40 comprises a generally cylindrical-shaped, enclosed region provided by a series of electrodes. An end of the second drift tube portion 34 coupled to the second polepiece 41 provides a first collector electrode 42. The first collector electrode 42 has a surface that tapers outwardly from the axial beam tunnel to define an interior wall of a collector cavity. The collector 40 further includes a second electrode 44, a third electrode 46, a fourth electrode 48, and a fifth electrode 52. The second, third and fourth electrodes 44, 46, 48 each have an annular-shaped main body with an inwardly protruding electron-collecting surface. The fifth electrode 52 serves as a terminus for the collector cavity, and may include an axially centered spike. The electrodes may further include grooved surfaces as described in copending patent application Ser. No. 09/533,896, filed Mar. 21, 2000, now U.S. Pat. No. 6,462,474, the subject matter of which is incorporated in the entirety by reference herein. The shapes of the electrodes may be selected to define a particular electric field pattern within the collector cavity. Moreover, it should be appreciated that a greater (or lesser) number of collector electrodes could be advantageously utilized, and that the five electrode embodiment described herein is merely exemplary. The electrodes are generally comprised of an electrically and thermally conductive material, such as copper coated with graphite or another form of carbon.

Each of the collector electrodes has a corresponding voltage applied thereto. In the embodiment shown, the second drift tube portion 34 is at a tube body voltage, such as ground, and the first collector electrode 42 is therefore at the same voltage. The other electrodes have other voltage values applied thereto ranging between ground and the cathode voltage. To prevent arcing between adjacent ones of the electrodes, insulating elements are disposed therebetween. The collector electrodes and insulators may be further contained within a pair of sleeves that provide a path for a flow of oil coolant. An example of an inductive output tube having an oil-cooled multi-staged depressed collector is provided by copending patent application Ser. No. 09/293,171, filed Apr. 16, 1999, now U.S. Pat. No. 6,429,589, the subject matter of which is incorporated in the entirety by reference herein.

In order to achieve the ideal efficiency, each electron of the beam would have to be collected after passing through the output gap by a collector electrode having the lowest possible potential; however, this does not always happen in practice. In an electron beam produced by a CEA, there are four classes of electrons that should be considered. First, there are electrons like those in the idealized scenario that pass through the output gap of the IOT and are collected on electrodes that have sufficient potential to collect the electrons at low energy. Second, there are electrons that are poorly focused and are intercepted at high potential during their first pass through the IOT. Third, there are electrons that are brought to zero kinetic energy at some equipotential within the collector region and are reflected back to a collector electrode that has somewhat higher potential than is needed to collect them. Finally, there are secondary electrons that are emitted as a result of primary beam electron impacts on collector electrodes. Electric fields in the collector region will accelerate some of these secondary electrons to collector electrodes with a higher potential than that of the collector stage they originated from. The last three classes of electrons mentioned above dissipate energy that could otherwise be recovered by the collector, thus causing a reduction in efficiency of the CEA. It should be appreciated that a conventional IOT having a single electrode collector stage will experience only the first two classes of electrons.

In a conventional IOT, the electron gun is typically made convergent to minimize cathode current density and maximize cathode life, while keeping the capacitance of the output gap at an absolute minimum. This provides relatively broad bandwidth and high impedance. To minimize the number of poorly focused electrons, the electron beam is confined by a magnetic field as it passes through the output gap. Some flux lines of the magnetic field will generally thread through the cathode, and these flux lines will then converge along the desired electron trajectories through the output gap. It is known that electrons tend to follow small-diameter, long-pitch, helical paths around a bundle of flux lines beginning from an origin of the electrons, as long as space-charge forces are low and the magnetic field intensity is high and changes slowly with distance. This ensures that no poorly focused electrons strike the drift tube when the current is low. As the current is increased at the peaks of the RF cycles by higher drive levels, increased space-charge forces cause the trajectories to rotate with some moderate angular velocity about the electron beam axis. This produces an additional inward force that balances the space-charge forces, so the focusing can be good over the wide range of currents at which the IOT must operate. This kind of focusing makes a transition from a confining field to what is sometimes called "space-charge balanced flow."

This type of focusing is generally acceptable for a conventional IOT. It ensures that the magnetic field will force the electron beam to have the correct shape as it passes from the cathode through the grid to the output gap regardless of whether the current is near zero or maximum as controlled by the grid voltage. Moreover, it is quite tolerant of badly designed electron guns. Once the beam has passed through the output gap, if the magnetic field is reduced rapidly to zero, the electrons will cross radial flux lines and are given momentum transverse to the beam axis that causes them to flow to the collector walls as is desired.

In a CEA, however, space-charge balance flow focusing causes the multi-staged depressed collector to operate less efficiently. As discussed above, it is desirable for each electron to penetrate into the multi-staged depressed collector until the electron has lost most of its initial kinetic energy, and only then be collected on an appropriate electrode. Transverse momentum caused by the electron beam leaving an axial magnetic field through a transition region where the field is primarily radial causes the beam to be thrown out against the collector electrodes nearest to the transition region. This results in some electrons being collected at high energy on one of the initial electrodes rather than travelling farther into the collector and being collected on one of the subsequent electrodes.

There is another kind of focusing known for use in linear beam tubes referred to as Brillouin flow. In Brillouin focusing, no magnetic flux threads the cathode surface. Instead, the magnetic flux is introduced as the beam approaches its minimum diameter, as determined by the electrostatic fields of electrodes around the cathode. As the electrons pass through a hole in the magnetic polepiece and enter the magnetic field, they cross radial magnetic flux lines. This gives the beam angular momentum. The angular velocity of the electrons interact with the axial magnetic field producing inward forces on the electrons that just balance the space-charge forces plus the centrifugal forces. In a beam of uniform charge density (which most IOT guns do not produce), Brillouin focusing produces what is sometimes referred to as "rigid-rotor" equilibrium. That is, the angular velocity of each beam electron is the same, and the centrifugal forces, the space-charge forces, and the magnetic forces all increase in proportion to radius. The Brillouin field is the lowest field that can focus an electron beam of a given charge density and axial velocity. When a Brillouin focused beam leaves a magnetic field, the beam loses the spin that was given to it when it entered the field, and so leaves with substantially no excess transverse momentum in contrast with a beam that was formed in a magnetic field, i.e., with flux threading the cathode. A problem in achieving Brillouin focusing over a wide range of beam currents is that the current density must be kept constant so that the beam area grows and shrinks in proportion to the current.

Figure 2:
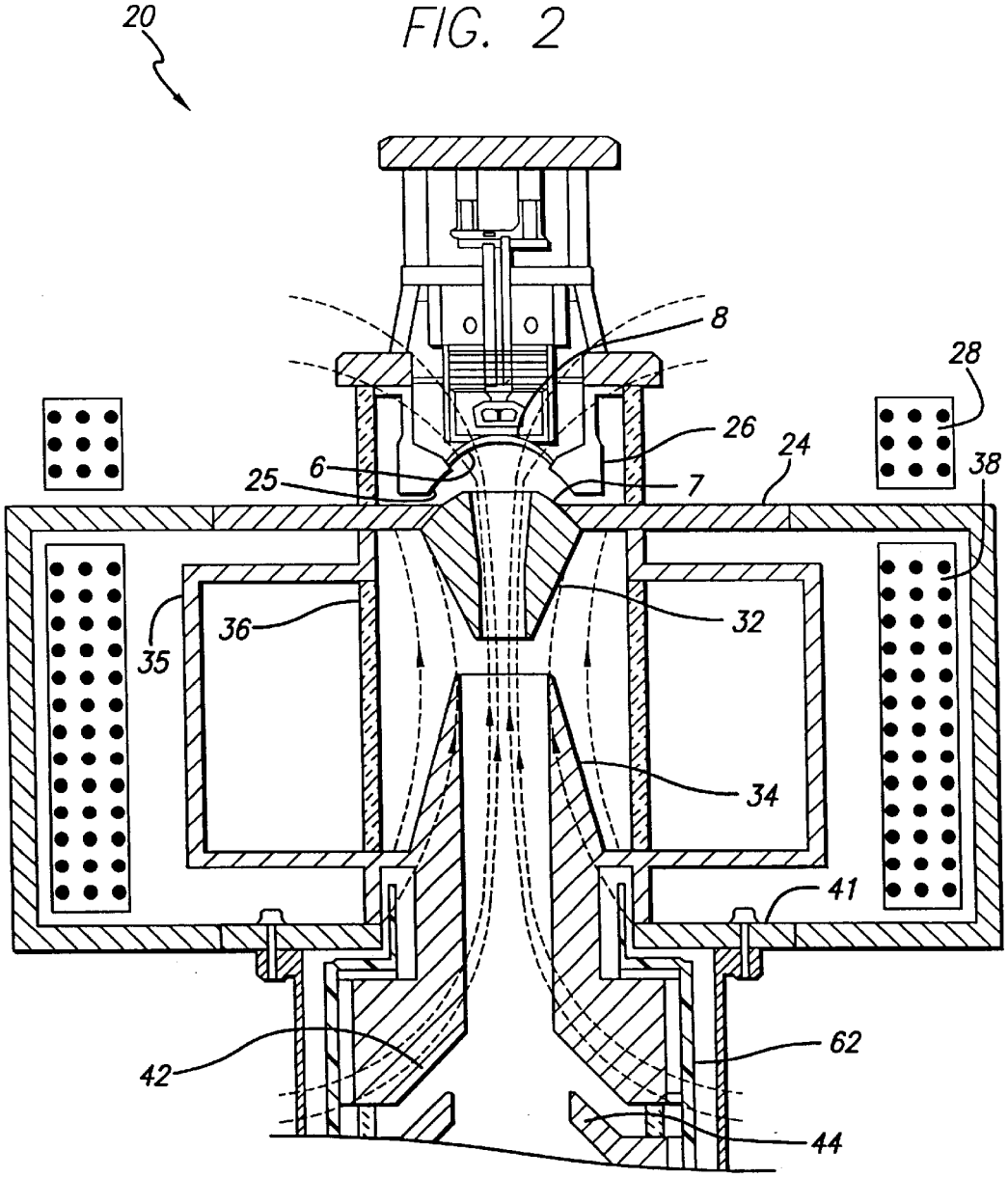
FIG. 2 is an enlarged portion of the exemplary inductive output tube illustrating magnetic flux lines used for focusing the electron beam.

FIG. 2 illustrates an embodiment of the electron gun 20 and tube body 30 in greater detail. The magnetic coil 38 produces a magnetic field aligned with the axial beam tunnel that maintains the electron beam in focus throughout its travel through the tube body 30. The magnetic field is illustrated in FIG. 2 as a plurality of flux lines (shown as dotted lines) extending between the first and second polepieces 24, 41. In the region between the polepieces 24, 41 and within the axial beam tunnel, the flux lines are substantially parallel. Conversely, at either end of the beam tunnel adjacent to the polepieces 24, 41, the flux lines exhibit a greater degree of radial component and converge inwardly or diverge outwardly. At the electron gun 20 end of the device, the flux lines continue to flare outwardly after passing the first polepiece 24 and thread through the control grid 6 and cathode 8. Similarly, at the collector 40 end of the device, the flux lines flare outwardly after passing the second polepiece 41 and thread through the first collector electrode 42.

As described above, conventional inductive output tubes are purposely designed so that the magnetic flux lines thread through the cathode, as shown in FIG. 2. With this type of focusing field, referred to as confined flow focusing, the electron trajectories follow the magnetic flux lines from the cathode and into the beam tunnel. As the electron beam leaves the cathode and enters the main part of the focusing field, the increase in flux density encountered must be sufficient to produce a magnetic focusing force that counterbalances the space charge and centrifugal forces of the beam. The focusing force results from the interaction of the beam rotation with the axial magnetic field. Nevertheless, as discussed above, this type of focusing results in a greater portion of the electrons entering the collector to strike the first collector electrode, with fewer electrons passing all the way to the fifth collector electrode.

In an embodiment of the invention, an additional magnetic solenoid coil 28, referred to as a bucking coil, is added adjacent to the input cavity on the cathode side of the polepiece 24. The bucking coil 28 produces a magnetic field directed opposite that of the magnetic coil 38, so as to effectively cancel the flux lines threading through the cathode. The electrical current applied to the bucking coil 28 is opposite to the direction of current in the magnetic coil 38, and can be adjusted to vary the strength of the canceling magnetic field. Ideally, the total of magnetic flux lines through the cathode is kept to less than approximately 10% of the flux lines in the beam in the interaction region of the tube between the input and output polepieces and the cavity where the magnetic field is the most intense. When the field of this bucking coil 28 bucks the normal cathode field, it produces a marked increase in the amount of current that reaches the fifth collector electrode and a reduction in the main focusing field for optimum beam transmission. This change increases the efficiency of the CEA at one-quarter power to about one-and-one-half times that of a conventional IOT. Alternatively, the same efficiency can be achieved by reducing the diameter of the hole in polepiece 24 in order to reduce the number of flux lines therethrough to less than 10% of the number in the beam.

Having succeeded in getting the electron beam to stay together at low currents for as long as possible, another embodiment of the invention utilizes a very long collector so that space charge forces will push the electrons out to the collector wall of the last collector electrode. It is undesirable for secondary electrons generated from electron impacts to escape, so having a long collector electrode as the final electrode in the collector is advantageous. For example, it would be advantageous to provide an electron collector where there are three or more collector electrodes and the final electrode at the lowest relative potential is physically longer than any of the prior collector electrodes, and the first electrode may optionally be connected to the body of the device.

The results achieved with the bucking field strongly suggest that it would be advantageous to approximate Brillouin focusing in a CEA over as large a range of beam currents as possible. This Brillouin equilibrium allows the greatest amount of current to be focused with a minimum magnetic field, but it requires a beam of uniform and constant current density. Brillouin focusing of the beam is initiated as the electron beam crosses radially directed components of the magnetic flux lines, as shown in FIG. 3. Electrons above the axis of the beam encounter a component of magnetic flux that is radially directed downward, producing a magnetic force on the electrons that is directed out of the paper. In contrast, electrons below the axis encounter a component of magnetic flux that is radially directed upward, producing a magnetic force on the electrons that is directed into the paper. These magnetic forces cause the electron beam to start rotating in the clockwise direction as it enters the magnetic field. The rotation of the beam interacting with the axial components of magnetic flux produce the magnetic focusing force, with each electron in the beam following a substantially helical trajectory about the axis of the beam, as shown in FIG. 4.

As noted above, the electrons of the electron beam are following helical paths rather than straight lines. When a Brillouin beam enters the magnetic field it picks up a twist with all the electrons essentially following concentric helices. Not only are there a multiplicity of helices of different radiuses, there are also a multiplicity of helices of different phase. The outer helices have more circumferential velocity. At the collector end of the device, the reverse situation occurs and the electrons leave the magnetic field across radial flux lines that extend outward instead of inward and the transverse energy that was on the beam gets turned back into axial energy.

In contrast, electrons of a confined flow beam don't have much transverse velocity because they were born in a magnetic field. These electrons only acquire transverse velocity as they leave the magnetic field, which causes the beam to spread. As a result, the beam spreading is much worse if you start out with a confined flow beam than it is with Brillouin flow. As explained above, a lot of power in a constant efficiency amplifier is wasted by electrons that haven't lost a great deal of energy and are carrying a tremendous amount of kinetic energy being collected on an electrode that is not optimum. Since these electrons still have most of their energy, a depressed collector is advantageous because it allows this energy to be recovered. So, if the electron beam starts out with Brillouin focusing in which transverse energy is minimized and the current is low, the electrons will tend to go a long way into the collector. Thus, what happens in the collector is exactly the reverse of what happened when the beam was initially formed.

Initial studies of the electron guns used on conventional IOTs showed, at moderate beam current, fairly uniform current density with a peak at the edge; however, at low current, the beam was quite hollow because the anode is quite close to the outer edge of the cathode. It is believed that the improved low-current transmission to the fifth collector electrode with a bucking field on the cathode must be giving the hollow beam excess angular momentum that it loses as it exits the magnetic field in the collector so it can flow to the last collector electrode. This yielded a marked improvement in performance over an electron gun using confined flow, but it certainly was not close to ideal Brillouin flow either. In another embodiment of the invention, the shape of the grid 6 is altered by changing the grid-bar pitch with radius in order to achieve a more uniform, or even a "hot" centered beam current density profile. The grid is generally configured with a plurality closely spaced perforations, such as a plurality of concentric rings (arcs, slots, circles, or hexagons) with radial webs holding the rings together. In this embodiment, the grid bar circles that are concentric are spaced approximately 0.028 inch center-to-center at the edge of the grid, and toward the center of the grid the spacing is increased to approximately 0.033 inch or greater center-to-center.

Referring to the physical configuration of the electron gun portion of the device, there is a spacing between the anode and the cathode that is smaller at the outside edge of the cathode than it is at the center of the cathode. Since the anode has a hole in the middle in front of the cathode, the electric field from the anode is strongest at the edge of the grid. This electric field extends through the gap between the concentric rings of the grid and draws out current from the cathode. In the middle of the grid, electron current is essentially cut-off since the electric field at the center of the cathode is negative. If there is a negative voltage on the grid at the outside edge, the negative field from the grid is overcome by the positive field from the anode which is poking through the gap between grid bars. As a result, a lot of current is drawn at the edge of the grid resulting in a hollow beam. To address this problem, it is desirable to make the grid cut-off field substantially uniform across the surface of the grid, or even highest at the outer edge of the grid. This is achieved by opening up the distance between concentric rings at the center of the grid.

Also, it is advantageous to increase the distance between the cathode and anode to get rid of the spherical aberration, and also to move the focus electrode outward to increase the distance between the cathode and focus electrode so the electron beam is not converged so much. As the grid is made more positive and the space charge goes up in the beam, the beam tends to be somewhat larger because the space charge force is forcing the electrons apart as they travel from cathode to anode. The current density goes up and the charge density goes up, which tends to push the electrons apart. This further allows the electron beam to approximate Brillouin flow over the wide range of currents because the space charge force keeps making the beam bigger.

Also, at high current, it was found that there was severe spherical aberration of the electron beam and some electrons scalloped badly. In another embodiment of the invention, spherical aberration of the electron beam is decreased by increasing cathode-anode spacing and improving the entrance conditions to the magnetic field by moving the polepiece relative to the cathode and anode. Based on recent computer simulations, the electron beam achieves smooth Brillouin flow at seven or eight amperes. At lower current, the beam exhibits scalloping (i.e., oscillations of the beam diameter) because it enters the magnetic field at too small a diameter. However, at low current the beam never exceeds the diameter for eight amperes, and transmission is good. At currents above eight amperes, the beam scallops between the eight ampere Brillouin diameter and a maximum diameter just smaller than the drift tube, so transmission is still good up to about fifteen amperes. Any relatively slow electrons having little energy with the beam operating at high power will be collected on the first collector electrode, as desired.

In yet another alternative embodiment of the invention, the fourth and fifth collector electrodes are connected together. At one-quarter of the peak output power of 60 kW, while there was some efficiency improvement, it was small. It was suspected that secondary electrons from the fifth collector electrode were flowing to earlier collector electrodes. To verify this, the fourth collector electrode was connected to the fifth collector electrode, and this yielded some improvement in efficiency. Evidently, the fourth collector electrode shielded secondary electrons coming from the fifth collector electrode from the electric fields of the earlier collector electrode stages. In yet another embodiment, the third, fourth, and fifth collector electrodes are connected together, and the CEA was run as a three-stage tube with a further reduction of secondary loading. This yielded an average efficiency of 56% on an 8VSB signal. In still another embodiment of the invention, an eight-stage collector yielded even better performance. This alternative device achieved 60 percent average efficiency on an 8VSB signal, when operated as a five-stage tube with the last four collector electrodes connected together.

FIG. 5 reflects efficiency data of an air-cooled 65 kW CEA having collector electrodes at 9, 15, 17, 23 and 32 kV with reference to the cathode. The IOT comparison assumes all collector currents are collected at 32 kV. The measurements are taken using rectangular input drive pulses with 10 percent duty factor. The CEA that was tested included the foregoing embodiments relating to approximating Brillouin focusing.

Having thus described a preferred embodiment of an inductive output tube with a Brillouin electron beam focusing field, it should be apparent to those skilled in the art that certain advantages of the described method and system have been achieved. It should also be appreciated that various modifications, adaptations, and alternative embodiments thereof may be made within the scope and spirit of the present invention.

What is claimed is:

1. An amplifying apparatus, comprising:

an electron gun including a cathode, an anode spaced therefrom, and a grid disposed between said cathode and anode, said cathode providing an electron beam that passes through said grid and said anode, said grid being coupled to an input radio frequency signal that density modulates said electron beam;

a drift tube extended from and concentric with said electron gun and anode and surrounding said electron beam, said drift tube including a first portion and a second portion, a gap being defined between said first and second portions;

a first polepiece comprising a first centered hole through which said first drift tube portion passes, a first side of said first polepiece facing said cathode, and a second side of said first polepiece facing away from said cathode;

a second polepiece comprising a second centered hole through which said second drift tube portion passes, a first side of said second polepiece facing said cathode, and a second side of said second polepiece facing away from said cathode;

a first magnetic solenoid located between said first polepiece and said second polepiece and generating magnetic flux, said magnetic flux guiding said electron beam as it passes through said first and second drift tube portions and said gap, a portion of said magnetic flux threading through said cathode;

a second magnetic solenoid located on said first side of said first polepiece and producing a magnetic field that effectively cancels said portion of said magnetic flux threading through said cathode;

an output cavity connected with said first and second drift tube portions and enclosing said gap, said density modulated beam passing across said gap and coupling an amplified radio frequency signal into said output cavity; and a collector extended from said second drift tube portion and said second polepiece, said electron beam passing into said collector after transit across said gap, said collector having a plurality of electrode stages comprising a first electrode stage and at least one remainder electrode stage, said first electrode stage being connected electrically with said second drift tube portion, said plurality of electrode stages being insulated from each other, said remainder electrode being connected to an electrical potential source having an electrical potential less than that of an electrical potential on said anode, an electrical potential on said first drift tube portion and an electrical potential on said second drift tube portion.

2. The amplifying apparatus of claim 1, wherein said first electrode stage is joined mechanically to said second drift tube portion.

3. The amplifying apparatus of claim 1, wherein said remainder electrode stage comprises a last electrode stage having an inner length and a minimum inner diameter and wherein said inner length is at least twice said minimum inner diameter.

4. The amplifying apparatus of claim 1, wherein said remainder electrode stage comprises at least two electrode stages that are connected together electrically, wherein said at least two electrode stages comprises a total inner length and a minimum inner diameter, and wherein said total inner length exceeds twice said minimum inner diameter.

5. The amplifying apparatus of claim 1, wherein said remainder electrode stage comprises a last electrode stage and a penultimate electrode stage and wherein said last electrode stage is connected to a potential slightly higher than that of said penultimate stage.

6. The amplifying apparatus of claim 1, wherein said remainder electrode stage comprises second, third, fourth, and fifth electrode stages and wherein said first electrode stage is mechanically and electrically joined to said second drift tube portion.

7. The amplifying apparatus of claim 1, wherein said second magnetic solenoid is adapted to guide said electron beam to approximate a Brillouin beam flow.

8. The amplifying apparatus of claim 7, wherein said distance between said anode and said cathode is selected to further allow said electron beam to approximate said Brillouin beam flow.

9. The amplifying apparatus of claim 1, wherein said cathode comprises an emitting surface for emitting said electron beam and wherein said grid comprises an electrically conductive material, said electrically conductive material comprising a plurality of closely spaced perforations opposing said emitting surface.

10. The amplifying apparatus of claim 9, wherein each of said perforations has a predetermined minimum dimension and wherein said predetermined minimum dimension is selected from the group consisting of a dimension of a width of an arc, a dimension of a width of a slot, a dimension of a diameter of a circle, or a dimension of a distance between opposite faces of a hexagon.

11. The amplifying apparatus of claim 9, wherein said grid perforations near an outside edge of said cathode have a first predetermined minimum dimension and said grid perforations near an axis of said cathode have a second predetermined minimum dimension and wherein said first predetermined minimum dimension is smaller than said second predetermined minimum dimension.

12. The amplifying apparatus of claim 9, wherein said grid perforations comprise a plurality of predetermined minimum dimensions and wherein said predetermined minimum dimensions decrease continuously with increasing distance from an axis of said cathode and said grid.

13. The amplifying apparatus of claim 1, wherein said grid perforations are dimensioned to provide a higher current density near an axis of said electron beam for a given total current than would otherwise occur at a grid having perforations of uniform dimension.

14. The amplifying apparatus of claim 1, wherein said second magnetic solenoid comprises a magnetic coil.

15. The amplifying apparatus of claim 14, wherein said magnetic coil is a bucking coil.

16. The amplifying apparatus of claim 1, wherein said magnetic field produced by said second magnetic solenoid is opposite that of a magnetic field produced by said first magnetic solenoid.

17. The amplifying apparatus of 16, wherein said magnetic field produced by said second magnetic solenoid is adjustable.

18. The amplifying apparatus of claim 1, wherein said magnetic field produced by said second magnetic solenoid effectively cancels said portion of said magnetic flux line to less than approximately 10% of said flux line.

19. An amplifying apparatus, comprising:

an electron gun including a cathode, an anode spaced therefrom, and a grid disposed between said cathode and anode, said cathode providing an electron beam that passes through said grid and said anode, said grid being coupled to an input radio frequency signal that density modulates said electron beam;

a drift tube extended from and concentric with said electron gun and anode and surrounding said electron beam, said drift tube including a first portion and a second portion, a gap being defined between said first and second portions;

a first polepiece comprising a first centered hole through which said first drift tube portion passes, a first side of said first polepiece facing said cathode, and a second side of said first polepiece facing away from said cathode;

a second polepiece comprising a second centered hole through which said second drift tube portion passes, a first side of said second polepiece facing said cathode, and a second side of said second polepiece facing away from said cathode;

a first magnetic solenoid located between said first polepiece and said second polepiece and generating magnetic flux, said magnetic flux guiding said electron beam as it passes through said first and second drift tube portions and said gap, a portion of said magnetic flux threading through said cathode;

means for reducing said portion of said magnetic flux;

an output cavity connected with said first and second drift tube portions and enclosing said gap, said density modulated beam passing across said gap and coupling an amplified radio frequency signal into said output cavity; and a collector extended from said second drift tube portion and said second polepiece, said electron beam passing into said collector after transit across said gap, said collector having a plurality of electrode stages comprising a first electrode stage and at least one remainder electrode stage, said first electrode stage being connected electrically with said second drift tube portion, said plurality of electrode stages being insulated from each other, said remainder electrode being connected to an electrical potential source having an electrical potential less than that of an electrical potential on said anode, an electrical potential on said first drift tube portion and an electrical potential on said second drift tube portion.

20. The amplifying apparatus of claim 19, wherein said reducing means comprises a hole extending through said first drift tube portion and wherein said hole is adapted to reduce said portion of said flux.

21. The amplifying apparatus of claim 20, wherein a diameter of said hole is dimensioned to reduce said portion of said flux to less than approximately 10% of said flux.

22. The amplifying apparatus of claim 19, wherein said reducing means comprises a second magnetic solenoid located on said first side of said first polepiece and producing a magnetic field that reduces said portion of said magnetic flux threading through said cathode.

23. The amplifying apparatus of claim 19, further comprises means for guiding said electron beam to approximate a Brillouin beam flow.

24. The amplifying apparatus of claim 19, wherein said first electrode stage is joined mechanically to said second drift tube portion.

25. An amplifying apparatus, comprising:

an electron gun including a cathode, an anode spaced therefrom, and a grid disposed between said cathode and anode, said cathode providing an electron beam that passes through said grid and said anode, said grid being coupled to an input radio frequency signal that density modulates said electron beam;

a drift tube extended from and concentric with said electron gun and anode and surrounding said electron beam, said drift tube including a first portion and a second portion, a gap being defined between said first and second portions;

a first polepiece comprising a first centered hole through which said first drift tube portion passes, a first side of said first polepiece facing said cathode, and a second side of said first polepiece facing away from said cathode;

a second polepiece comprising a second centered hole through which said second drift tube portion passes, a first side of said second polepiece facing said cathode, and a second side of said second polepiece facing away from said cathode;

a first magnetic solenoid located between said first polepiece and said second polepiece and generating magnetic flux, said magnetic flux guiding said electron beam as it passes through said first and second drift tube portions and said gap, a portion of said magnetic flux threading through said cathode;

means for focusing said electron beam to approximate a Brillouin beam flow;

an output cavity connected with said first and second drift tube portions and enclosing said gap, said density modulated beam passing across said gap and coupling an amplified radio frequency signal into said output cavity; and a collector extended from said second drift tube portion and said second polepiece, said electron beam passing into said collector after transit across said gap, said collector having a plurality of electrode stages comprising a first electrode stage and at least one remainder electrode stage, said first electrode stage being connected electrically with said second drift tube portion, said plurality of electrode stages being insulated from each other, said remainder electrode being connected to an electrical potential source having an electrical potential less than that of an electrical potential on said anode, an electrical potential on said first drift tube portion and an electrical potential on said second drift tube portion.

26. The amplifying apparatus of claim 25, wherein said focusing means comprises a first magnetic solenoid located on said second side of said first polepiece and generating a magnetic flux, a portion of said magnetic flux threading through said cathode.

27. The amplifying apparatus of claim 26, wherein said focusing means further comprises means for reducing said portion of said magnetic flux.

28. The amplifying apparatus of claim 27, wherein said reducing means comprises a second magnetic solenoid located on said first side of said first polepiece and producing a magnetic field that reduces said portion of said magnetic flux threading through said cathode.

* * * * *